US006651537B1

(12) United States Patent
Pfeiffer

(10) Patent No.: US 6,651,537 B1
(45) Date of Patent: Nov. 25, 2003

(54) CUTTER FOR LINERLESS PAPER

(75) Inventor: Horst Pfeiffer, Aldingen (DE)

(73) Assignee: Firma Hengstler GmbH, Aldingen (DE)

( * ) Notice: Subject to any disclaimer, the term of this patent is extended or adjusted under 35 U.S.C. 154(b) by 0 days.

(21) Appl. No.: 09/466,170

(22) Filed: Dec. 17, 1999

(30) Foreign Application Priority Data

Dec. 3, 1999 (DE) ..... 199 58 274

(51) Int. Cl.[7] ..... B26D 5/22; B26D 1/04; B26D 7/32

(52) U.S. Cl. ..... 83/436.75; 83/364; 83/368; 83/582; 83/614; 83/631; 83/698.21

(58) Field of Search ..... 83/631, 698.21, 83/614, 436.75, 266, 364, 368, 508, 509, 510, 582

(56) References Cited

U.S. PATENT DOCUMENTS 1,290,097 A * 1/1919 Cook ..... 83/509 X
1,998,357 A * 4/1935 Carlson ..... 83/509 X
2,623,586 A * 12/1952 Volpi ..... 83/509 X
3,558,254 A * 1/1971 Cahill ..... 83/176
4,331,055 A * 5/1982 Kammann et al. ..... 83/510 X
4,519,285 A * 5/1985 Dontscheff ..... 83/508 X
4,535,664 A * 8/1985 Raymond ..... 83/614 X
4,817,483 A * 4/1989 Armbruster ..... 83/614 X
4,864,906 A * 9/1989 Hall ..... 83/614 X
5,003,856 A * 4/1991 Fujimura et al. ..... 83/614 X
5,074,178 A * 12/1991 Shetley et al. ..... 83/364 X
5,094,134 A * 3/1992 Mizukoshi ..... 83/698.21
5,107,734 A * 4/1992 Armbruster ..... 83/614 X
5,111,724 A * 5/1992 Kanaga et al. ..... 83/509 X
5,168,786 A * 12/1992 Huggins et al. ..... 83/614 X
5,435,217 A * 7/1995 Kato et al. ..... 83/508 X
5,442,983 A * 8/1995 D'Angelo et al. ..... 83/614 X
5,560,293 A * 10/1996 Boreali et al. ..... 101/288
5,601,007 A * 2/1997 Clough et al. ..... 83/614 X
5,611,253 A * 3/1997 Saito et al. ..... 83/614 X
5,813,305 A * 9/1998 Miazga et al. ..... 83/614 X
6,152,619 A * 11/2000 Silverbrook ..... 83/631 X
6,161,458 A * 12/2000 Spatafora ..... 83/698.21 X
6,468,197 B1 * 10/2002 Lencoski et al. ..... 83/614 X

* cited by examiner

*Primary Examiner*—Charles Goodman
(74) *Attorney, Agent, or Firm*—Knobbe, Martens, Olson & Bear LLP

(57) ABSTRACT

A cutter for self-adhesive labels has a top part and a bottom part and a feeding gap between the top part and the bottom part. The cutter includes further a cutting mechanism having a blade and coupled to one of the top part and the bottom part. Further, the cutter has a transport and guiding device for the labels, wherein the transport and guiding device includes a transport roll located opposite the cutting mechanism. The feeding gap receives an adhesive paper or label sheet and the transport roll pulls the adhesive paper or label sheet through the feeding gap. The adhesive paper or label sheet passes between the cutting mechanism and the transport roll, and the blade cuts the adhesive paper or label sheet against a curved surface of the transport roll.

13 Claims, 7 Drawing Sheets

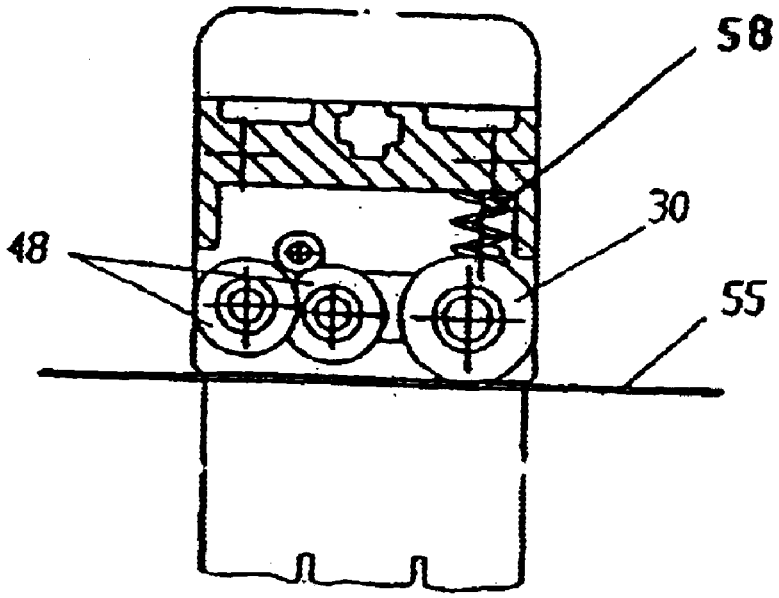
Fig. 3.1

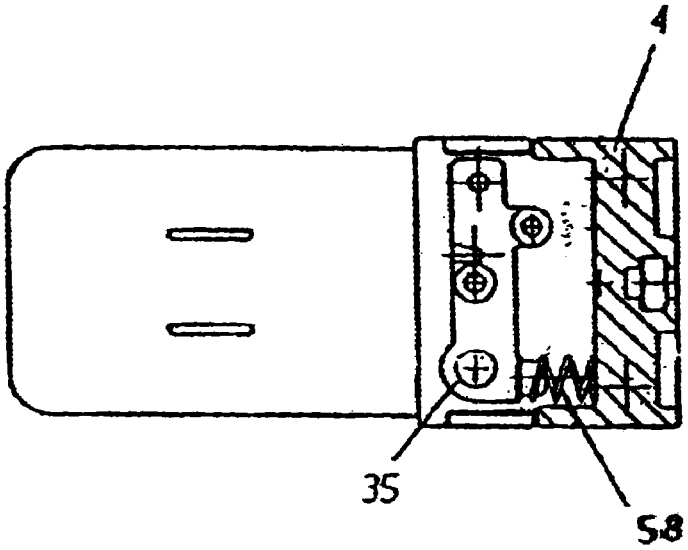
Fig. 4.1

CUTTER FOR LINERLESS PAPER

BACKGROUND OF THE INVENTION

1. Field of the Invention

The invention relates to a cutter for adhesive paper labels.

2. Description of the Related Art

Such adhesive labels are also referred to as linerless paper. Label paper is understood to mean paper on which the adhesive has been directly applied, which makes the label itself the carrier sheet, and therefore, has adhesive on one side. Specific difficulties exist when cutting such labels sheets—whether as reel sheets or as single sheets.

The term 'linerless paper' generally describes self-adhesive papers that are usually shaped like strips and rolled into rolls without carrier foil, and that are used to produce self-adhesive labels. Usually, the labels are printed by means of a strip printer using a thermal process and then cut from the strip by means of a cutter.

With regard to the self-adhesive labels on carrier foil, it must be mentioned that the labels are cut to size and positioned on a strip-shaped carrier at short intervals. The carrier material has a wax-life surface that allows the individual labels to be easily separated from the carrier material.

The advantages of linerless paper versus labels on carrier foil include the following:

1. Cost reduction due to elimination of carrier foil.
2. Space savings in the printing mechanism. (More labels on supply reel of same size)
3. Labels of any length can be produced.
4. There is no longer a need to roll up and store the empty carrier foil until the next reel change, which in turn saves construction space in the printing mechanism.
5. The user must no longer dispose of the empty carrier foil.
6. Cost reductions in the printing mechanism, the roll-up device for the carrier foil is not needed.

The following applies to the conventional cutting of linerless paper:

After the printing, the label must be cut to the desired length. This is usually done by means of a cutting mechanism that is driven by an electric motor or an electromagnet and that is positioned downstream from the printing mechanism. The following cutting principles exist:

1. Rotating a circular blade and a spring-attached stationary blade.
2. A shear blade attached with a spring to a stationary cutting strip (Guillotine).
3. A roller blade attached with a spring to a stationary cutting strip.

The aforementioned cutting principles have the disadvantage that the adhesive layer is sheared between two metal blades, which contaminates the blades with glue and the subsequent paper strip adheres to the contaminated blades causing a paper jam.

Blades that are contaminated with glue can frequently only be cleaned with chemicals and are usually difficult to access.

Another problem is the guiding of the paper strip between the printing mechanism and the cutter.

In order to avoid paper jams, fixed paper guiding and cutting elements are coated with non-stick coating in order to prevent the side of the paper that is covered with adhesive from adhering. In spite of the high cost and complexity, such devices still have a high failure rate.

SUMMARY OF THE INVENTION

There is therefore a need for further developing a cutter for adhesive paper sheets or label sheets in such a way that the cutting process can be repeated many times without malfunction and without the blade becoming contaminated by glue or the cutting process being disrupted by adhering glue residues.

In one embodiment of a cutter for self-adhesive labels, the cutter has a top part and a bottom part and a feeding gap between the top part and the bottom part. The cutter includes further a cutting mechanism having a blade and coupled to one of the top part and the bottom part. Further, the cutter has a transport and guiding device for the labels, wherein the transport and guiding device includes a transport roll located opposite the cutting mechanism. The feeding gap receives an adhesive paper or label sheet and the transport roll pulls the adhesive paper or label sheet through the feeding gap. The adhesive paper or label sheet passes between the cutting mechanism and the transport roll, and the blade cuts the adhesive paper or label sheet against a curved surface of the transport roll.

An essential characteristic of the invention is that a transport roll lined with an elastomer is located at the exit of the cutting mechanism. The tip of a blade penetrates, at least partly, into the lines of the transport roll, and it is moveable along and over this transport roll parallel to the axis of this transport roll and perpendicular to the transport direction.

From the described technical teaching, there is the essential advantage that because of the positioning of an elastomer transport roll at the exit of the device, now there is the advantage that the adhering paper or label band is pulled through the device and the blade is positioned ahead of the pulling device for the paper band performing the cut directly on the elastomer transport roll.

This provides the advantage that the paper sheet is pulled and no longer pushed through the device, which results in a substantially better guiding of the paper sheets.

Another advantage is that the tip of a simple straight blade penetrates into the elastomer liner of the transport roll providing excellent counter support for the paper sheet to be cut.

First, in sequential order from the top down, the paper sheet is cut and only then does the underlying layer of glue come to rest directly on the transport roll. The advantage of this measure is that the section cut off by the blade does not drop downward, since even after being cut off it is still held by the transport roll, because the cut-off piece still adheres to the transport roll with its glue layer.

This guarantees safe operational handling since the cut-off piece does not simply drop off and adhere to something inadvertently but rather can be taken off and processed further in a defined manner.

With this type of cutting technique there is the additional advantage that there is no need for a counter blade since the cutting support is constituted by the elastomer liner on the transport roll. Therefore, no adjustment problems exist, since even if the blade runs over the transport-roll in a tilted position, proper cutting of the paper sheet can still be guaranteed as long as the blade penetrates by several tenths of a millimeter into the elastomer liner.

This device is both a cutter and a presenter. The label paper with its self-adhesive underside is not pushed over stationary paper guiding and cutting elements but is fed over several rather narrow and easily rotating rolls, one of which is made of a non-stick material and is driven by a stepper motor so that it runs in sync with the printer drive. Since the transport roll is pressed against the top part by a spring, the paper strip is now transported by force through the cutter.

Cutting of the label is performed with a pointed sharp blade perpendicular to the paper strip on the apex line of the transport roll. The initial position of the blade is to the right or to the left at a distance from the paper strip and the transport roll.

In order to cut off the label from the paper strip, the blade that is attached to a guiding element is moved from the right to the left or from the left to the right by way of a spindle that is driven by an electrical motor. In this process the paper strip is cut from the non-adhesive side. The blade can be easily removed from the guide element and reinstalled into it for the purpose of cleaning or replacement.

The cutter consists of essentially two groups of components: the top part, which contains the parts for the cutting of the labels, and the bottom part, which provides the functions "transport and guiding of the label material." Top and bottom part are connected by a hinge and are locked into a unit by way of a locking bolt.

The support structure of top part and bottom part are pieces cut from profile rods so that cutters can be constructed with varying operational widths without a need for new tool expenses.

All parts are designed so that the hinge can be positioned to the right or to the left by means of only a different assembly and so that the locking flap is always positioned opposite the hinge.

The subject of the present invention not only results from the subjects of the individual claims but also from the combination of these individual claims with each other.

All data and characteristics disclosed in the documents, including the summary and in particular the spatial embodiments contained in the drawings, are claimed as essential for the invention in so far as they are novel as compared to the state of the art, either individually or combined.

BRIEF DESCRIPTION OF THE DRAWINGS

Below, the invention is more closely explained based on the drawings that constitute only embodiment options. Further characteristics and advantages that are essential to the invention result from the drawings and their descriptions.

Shown are:

FIG. 3.1: A side view corresponding to the top view for the bottom part of the device according to FIG. 1.

FIG. 4.1: A side view corresponding to the front view for the bottom part of the device according to FIG. 1 from inside.

DETAILED DESCRIPTION OF THE PREFERRED EMBODIMENT

Figure 1:
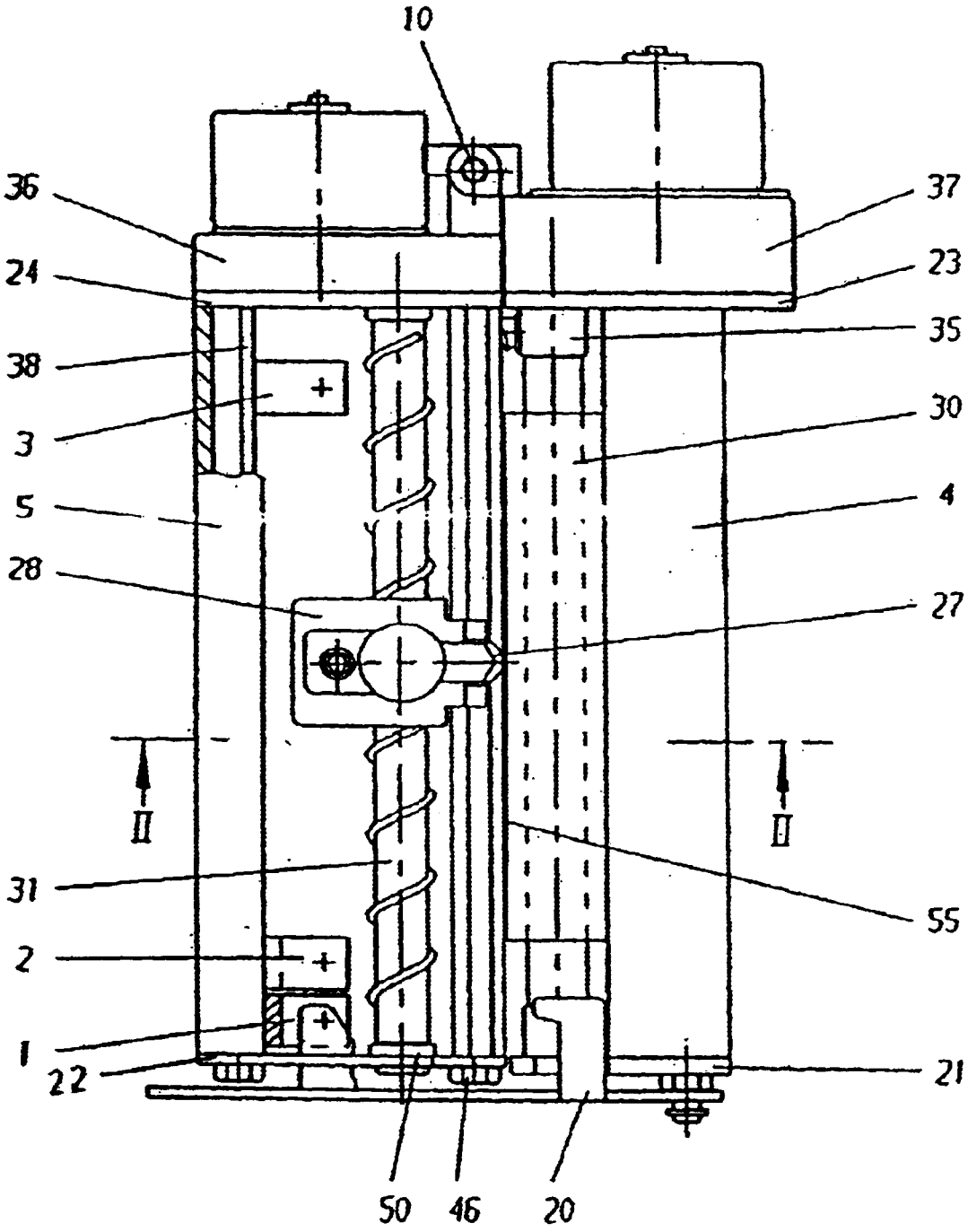
FIG. 1: A front view of the cutter in an operating position.

Basically, the following results from the FIGS. 1 through 4. One plate is attached to each side of a basic body 4. Plate 23 on the hinged side features threaded holes for the attachment of the adjacent gearbox 37 and other perforations and recesses for the retention of other parts. A second plate 21 that is also attached to the basic body 4 is positioned opposite from plate 23.

Figure 3:
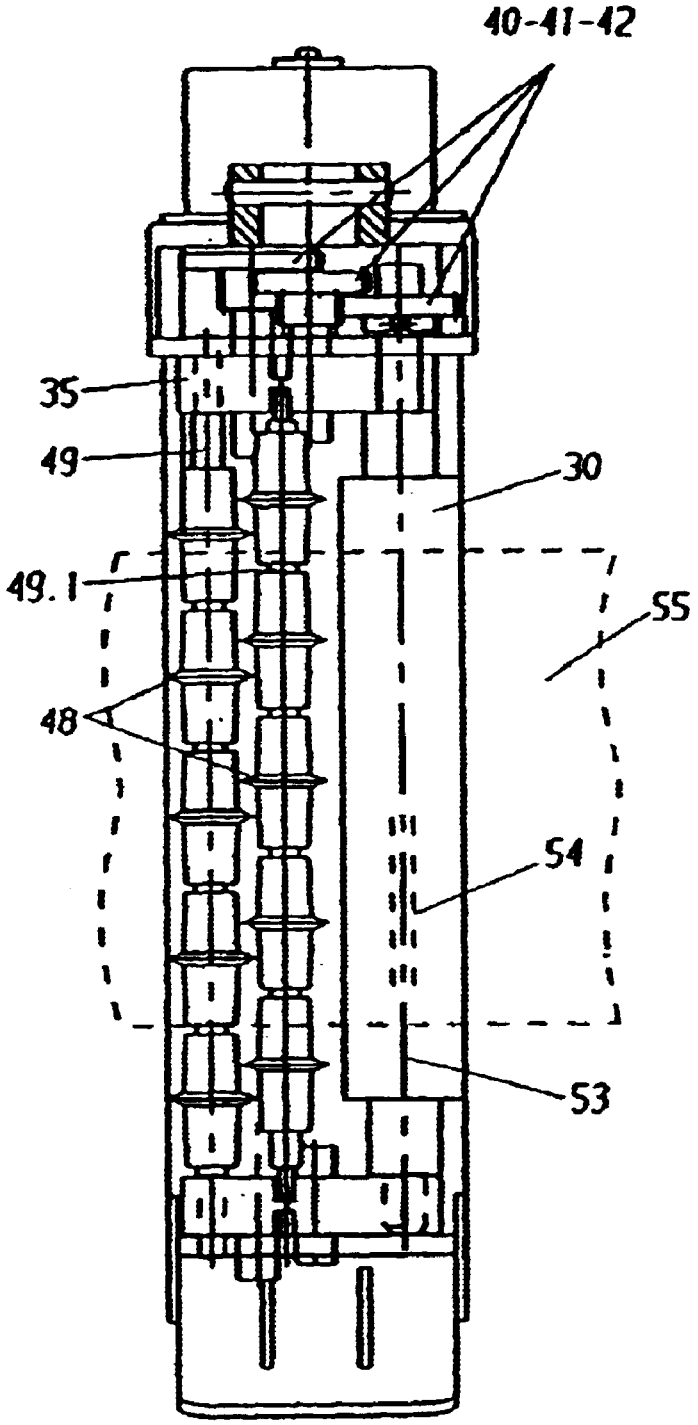
FIG. 3: A top view of a bottom part of the device according to FIG. 1.

In FIG. 3, a bearing 35 is located pivotably on each side of shaft 49 that is supported by the plates 21 and 23. The two bearings support the drive roll 30 and another shaft 49.1. The two shafts 49 and 49.1 hold several transport rolls 48 that rotate with ease. The bearing positioned on the side of the motor additionally features two short shafts for the support of the gear wheels 40, 41 and 42. Each bearing 35 features its own pressure spring 58 that ultimately presses the transport roll against the top part via the pivotable bearings.

In order to limit the pivoting distance, tube-shaped stops, which protrude into the recesses in the plates, are attached to both sides of the bearings 35. The retaining bolts 46 for the plate 21 are configured in such a manner that the locking bolt 20 can be attached to them in a way that allows the locking bolt to pivot.

In order to limit the pivoting distance, two arms of the locking bolt engage in recesses in plate 21 that have been provided for this purpose.

The gearbox 37 is located on the hinged side with the flange-attached stepper motor that drives the transport roll 30 via the gear wheels.

In FIG. 1, plates are bolted to both sides of a basic body 5 in the same way as to bottom part 4. The plate 22 on the locking side features, aside from two holes for the retention of attaching bolts, a second hole for the retention of a bearing 50 and further, a tongue that interfaces with a groove in the plate 21 and makes sure that the top part and the bottom part are aligned with each other as required for proper operation, as well as two rectangular openings, which engage two tongues of the locking bolt 20 and lock the top part to the bottom part.

Opposite the locking side, a second plate 24 is attached to the basic body 5 and it carries another bearing. 50 for the support of the drive spindle 31. The drive spindle is driven by a second stepper motor via gear wheels and causes the guide rack 28, holding a blade 27, to move from the locking side to the hinged side or from the hinged side to the locking side depending on the rotating direction of the spindle. Movement in one direction suffices to perform the cutting operation.

Figure 5:
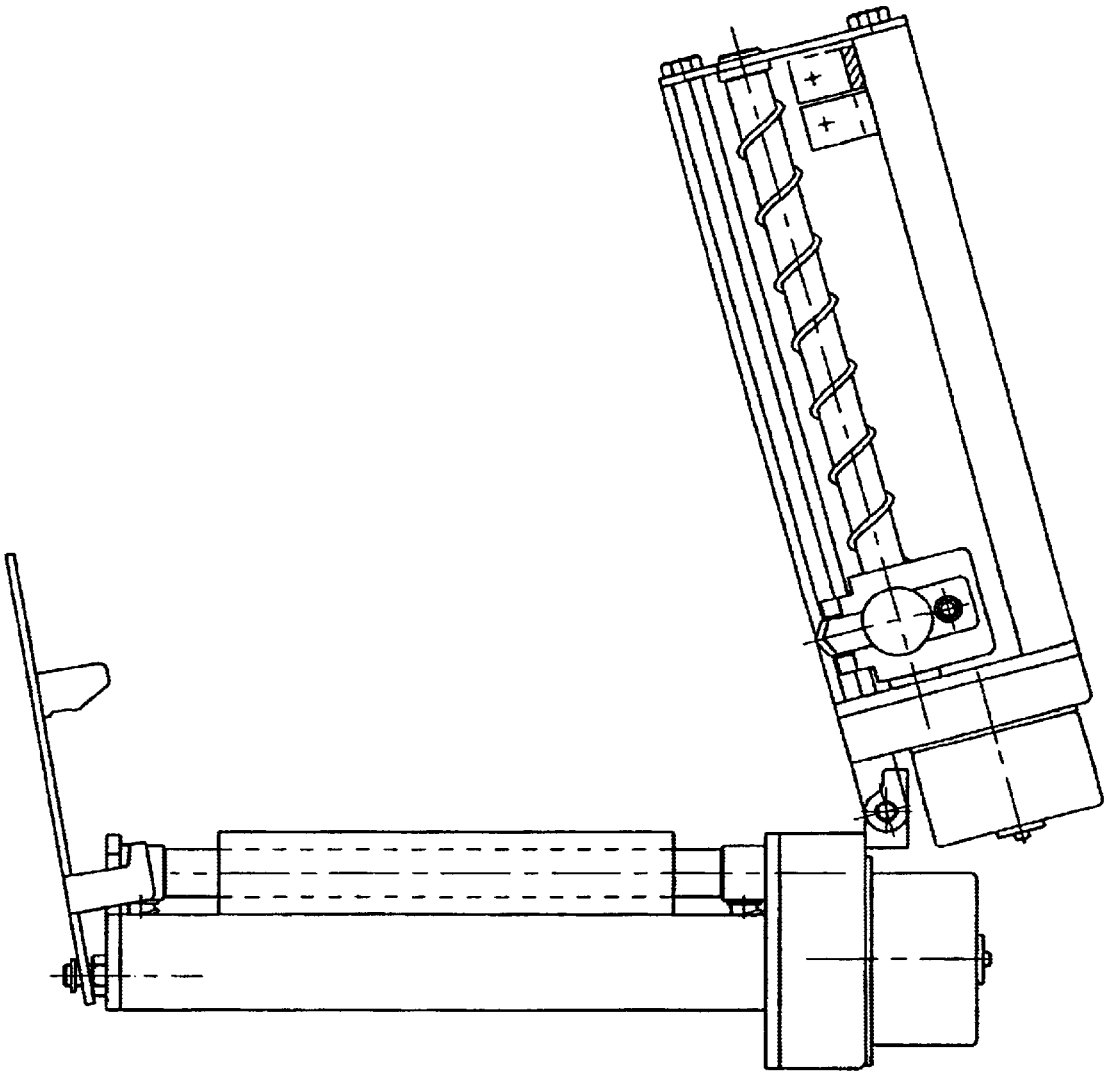
FIG. 5: The opened device with top and bottom part.

The casing 36 is attached to the plate 24 that is located on the hinged side, FIGS. 1 and 5. It is configured, in such a way that it forms a hinge in combination with the gearbox 37 of the bottom part, which makes the paper path freely accessible when the unlocked top part is tilted upwards.

A printed wiring board 38 located within the basic body 5 carries three transmitted-light barriers for sensors.

Sensor 1 is activated by the tongue of the locking bolt. With this sensor, the locked and ready-for-operation conditions of the cutter can be monitored.

The sensors 2 and 3 are activated by a lug mounted on guiding element 28 permitting the control of the position of the guiding element 28 and consequently also that of the blade 27.

The guiding element 28 serves mainly for the retention of the blade 27 and is located, when not in motion, to the right or to the left of the transport roll 30. A cam 64 located in the guiding element facilitates precise zero positioning of the blade tip in relation to the transport roll so that it is guaranteed that cutting the paper strip will not damage the transport roll.

For the secure retention of the blade within the guiding element, a cylindrical iron part 60 is attached to the back of the blade and a permanent magnet 62 is located in the guiding element. This arrangement facilitates easy disassembly and assembly of the blade 27 during cleaning or replacement.

Figure 2:
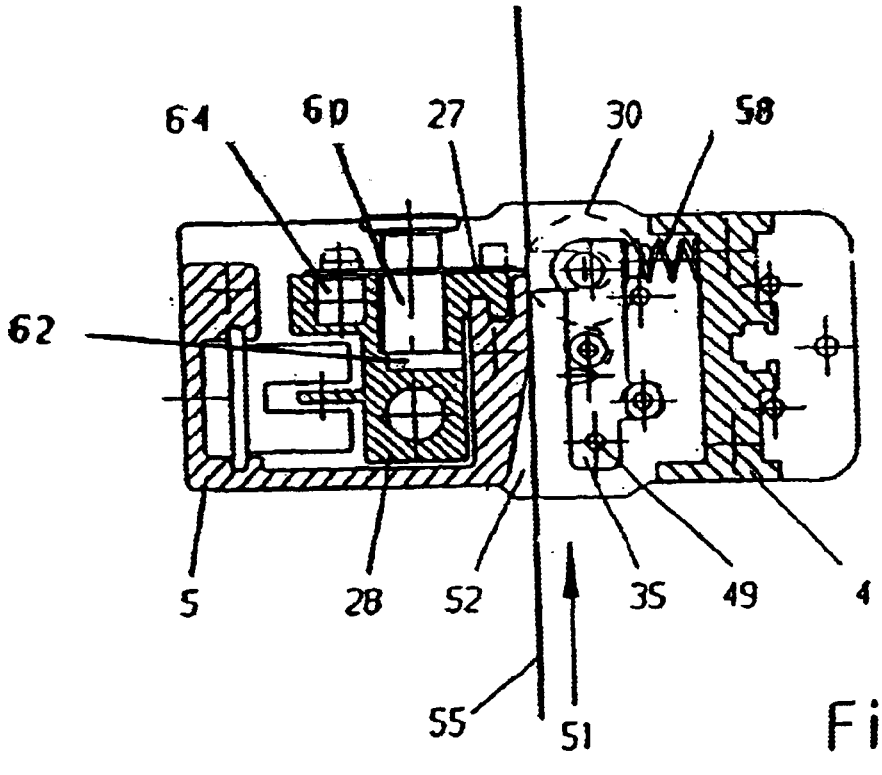
FIG. 2: A cross-sectional view along the line II—II in FIG. 1.

FIG. 1 shows that a paper 55 touches the transport roll 30 with its downward facing glue layer and is transported in the direction of the arrow 51 into a guiding gap 52 (see FIG. 2).

It is important in this context that the transport roll 30 is located below the blade 27 according to FIG. 2 so that the paper 55 is pulled through the device under tension, due to its support on the transport roll 30, with the blade landing on and cutting through the tightly stretched paper sheet.

The blade 27, then, moves precisely axis-parallel with the apex line 53 of the transport roll 30. A minor amount of off-set from this position is permissible; i.e. the blade may, within a certain range 54, come down in front of the apex line 53 or behind the transport roll and still perform a cut that is axially parallel to the shaft of the transport roll 30.

The advantages of the invention can be seen in that the adhesive-covered side of the label paper 55 does not come into contact with stationary paper guiding elements after leaving the printer, but is instead guided into the cutter via several rolls 48 that rotate with ease and on which the paper is supported at only one point.

It is a further advantage of the invention that the cutter features a transport roll 30 with non-stick characteristics, which, driven by a stepper motor and gear wheels, has the same travel speed as does the transport roll of the printing mechanism.

It is another advantage of the invention that, due to the motor-driven transport roll 30, the label material is not pushed through the cutter but pulled through it and that separation of the labels is performed with a blade 27 on the apex line 53 of the transport roll 30 and that the position of the blade 27, when it is not in motion, is located to the side of the paper strip and that glue residues that potentially adhere to the tip of the blade do not block the forward travel of the paper strip and that during the cutting of the labels the glue layer is not subject to shearing between two blades, which may lead to glue being pressed onto the cutting edges. (Glue residue on the cutting edges is almost always the cause for malfunctions such as, e.g., paper jams).

In general, the elastomer material of the transport roll 30 is selected so that the blade will not cause any cutting traces in the liner material of the transport roll 30. This is also considered when adjusting the penetration depth of the blade 27.

FIGS. 3, 3.1, 4 and 4.1 show the bottom part of the cutter. FIGS. 3 and 3.1 show the top view 3 and the side view 3.1 that corresponds to the top view 3, respectively, with the transport rolls 30, the shafts 49, 49.1 and the transport rolls 48. SIn FIG. 3, a paper 55 is indicated by a dashed line.

Figure 4:
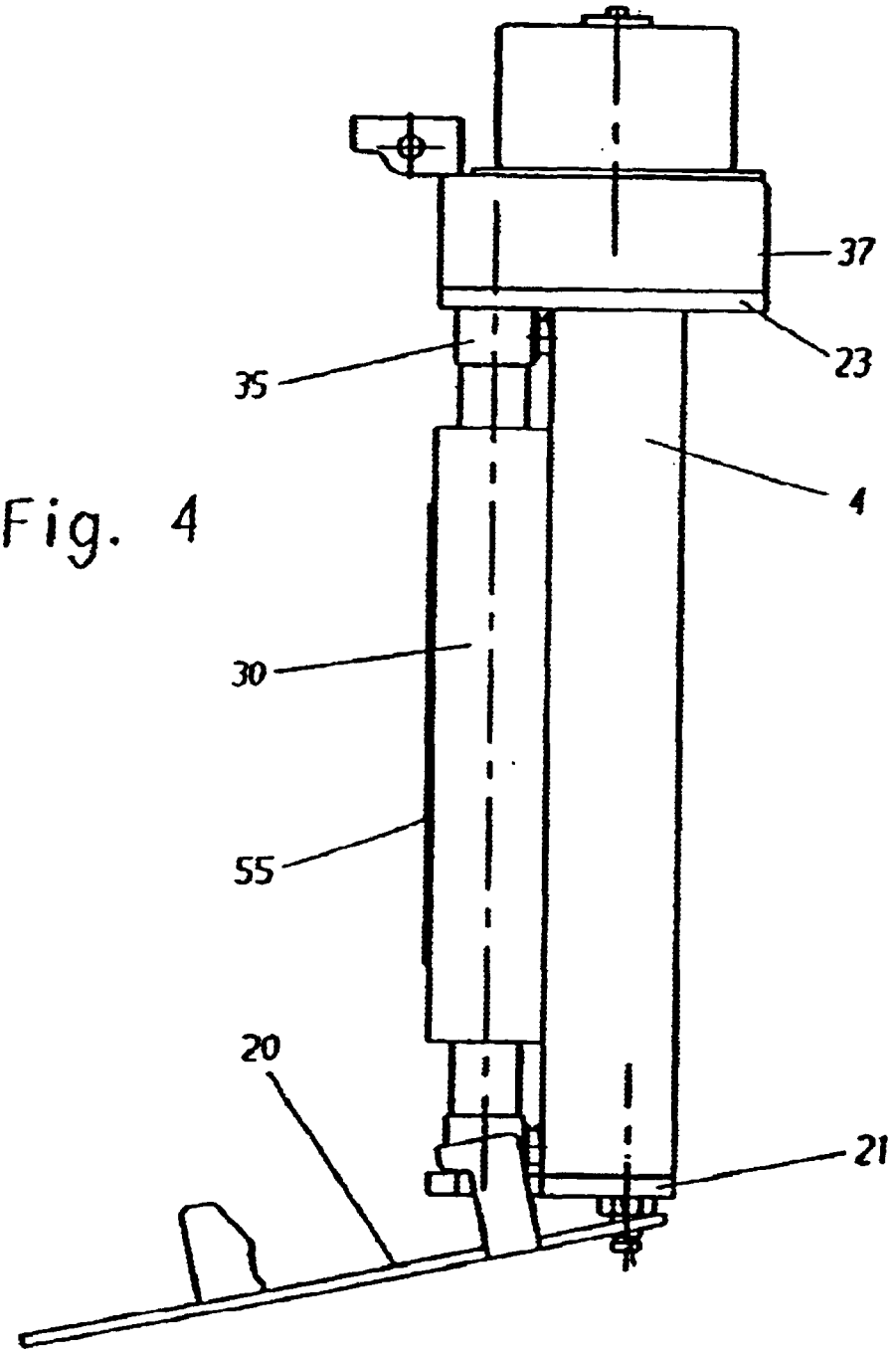
FIG. 4: A front view of the bottom part of the device according to FIG. 1.

The drawings in FIGS. 4 and 4.1 show the front view and the side view 4.1 that corresponds to the front view 4, respectively, from the inside without the top part of the cutter. In the drawing according to FIG. 5, the cutter according to the invention is also shown in a swung-open position.

What is claimed is:

1. A cutter for self-adhesive labels, wherein each self-adhesive label has an adhesive layer applied on one side so that the label constitutes a carrier tape, the cutter comprising:

a top part and one bottom part;

a feeding gap between the top part and the bottom part;

a cutting mechanism having a blade having a straight form and coupled to one of the top part and the bottom part; and a transport and guiding device for the labels, wherein the transport and guiding device includes a transport roll located opposite the cutting mechanism and a spring acting against the transport roll to press the transport roll against the top part, the spring exerting a force on the transport roll in a direction substantially opposite a force applied by the cutting mechanism, wherein a surface of the transport roll has an elastomeric liner, wherein the feeding gap receives an adhesive paper or label sheet and the transport roll pulls the adhesive paper or label sheet through the feeding gap, wherein the adhesive paper or label sheet passes between the cutting mechanism and the transport roll, wherein the blade cuts the adhesive paper or label sheet against a curved surface of the transport roll, wherein a tip of the blade penetrates the elastomeric liner while cutting the adhesive paper or label sheet, and wherein the blade is moveable in a direction parallel to a longitudinal axis of the transport roll and in a direction perpendicular to a transport direction of the adhesive paper or label sheet over the transport roll.

2. The cutter of claim 1, wherein the cutting mechanism and the transport and guiding device are configured so that the blade cuts the adhesive paper or label sheet before cutting an underlying adhesive layer of the adhesive paper or label sheet, which is in direct contact with the transport roll.

3. The cutter of claim 1, further comprising a guiding element and a drive spindle, wherein the blade is attached to the guiding element, and wherein the guiding element and the drive spindle, driven by an electric motor, moves the blade along a cutting line.

4. The cutter of claim 3, further comprising a cam located inside the guiding element, wherein the cam is configured to set an initial position of the tip of the blade in relation to the transport roll to ensure that cutting the adhesive paper or label sheet does not damage the transport roll.

5. The cutter of claim 3, wherein a cylindrical iron part is attached to a back of the blade for secure retention of the blade in the guiding element.

6. The cutter of claim 3, wherein a permanent magnet is located in the guiding clement facilitating disassembly and re-assembly of the blade during cleaning or replacement. the guiding element and the drive spindle, driven by an electric motor, moves the blade along a cutting line.

7. The cutter of claim 1, further comprising a plurality of rotatable rolls to provide for a plurality of points of support for the adhesive paper or label sheet during transport through the cutter, wherein the rolls contact an adhesive-coated side of the adhesive paper or label sheet only at the plurality of points of support.

8. The cutter of claim 7, wherein the rolls are made of a non-stick material.

9. The cutter of claim 1, wherein the adhesive paper or label sheet is guided through the cutter by being pulled.

10. The cutter of claim 1, further comprising first sensors configured to control a position of the blade.

11. The cutter of claim 1, wherein the cutter comprises a hinge for opening and closing the top and bottom parts of the cutter, and wherein the cutter further comprises second sensors configured to monitor if the cutter is in the open position or the closed position.

12. The cutter of claim 1, further comprising a hinge connecting the top part and the bottom parts and a locking flap located opposite the hinge and configured to secure the cutter in a closed position, wherein the hinge can be positioned to a right or to a left of the cutter and the locking flap is always located opposite the hinge.

13. The cutter of claim 1, wherein the elastomeric liner of the transport roll is made of a material such that no cutting traces appear in the elastomeric liner.

* * * * *